US012774551B2

(12) United States Patent
Chamois

(10) Patent No.: US 12,774,551 B2
(45) Date of Patent: Oct. 27, 2026

(54) SUPPORT SYSTEM FOR A LINEN BASKET AND CLOTHES PINS

(71) Applicant: Yves Chamois, Paita (FR)

(72) Inventor: Yves Chamois, Paita (FR)

( * ) Notice: Subject to any disclaimer, the term of this patent is extended or adjusted under 35 U.S.C. 154(b) by 0 days.

(21) Appl. No.: 18/379,638

(22) Filed: Oct. 12, 2023

(65) Prior Publication Data

US 2024/0328061 A1 Oct. 3, 2024

(30) Foreign Application Priority Data

Oct. 13, 2022 (GB) ..... 2215129

(51) Int. Cl.

| | |
|---|---|
| ***D06F 57/02*** | (2006.01) |
| *A47B 57/04* | (2006.01) |
| *A47B 61/00* | (2006.01) |
| *A47G 25/74* | (2006.01) |

(52) U.S. Cl.

CPC ..... *D06F 57/02* (2013.01); *A47B 57/04* (2013.01); *A47B 61/003* (2013.01); *A47G 25/743* (2013.01)

(58) Field of Classification Search

CPC .. D06F 57/02; D06F 57/04; A47F 5/04; A47F 5/05; A47F 7/18; A47F 7/19; A47F 7/22; A47F 7/10; A47F 7/12; A47G 25/02; A47G 25/06; A47B 61/003; A47B 57/04

See application file for complete search history.

(56) References Cited

U.S. PATENT DOCUMENTS

| | | | | | |
|---|---|---|---|---|---|
| 500,006 | A | * | 6/1893 | Kadletz | A47F 5/04 211/1 |
| 561,634 | A | * | 6/1896 | Walsh | D06F 53/02 211/119.13 |
| 639,549 | A | | 12/1899 | Fitzgerald | |
| D34,227 | S | * | 3/1901 | Morrow | D6/681.2 |
| 803,847 | A | | 11/1905 | Pereira | |
| 1,020,446 | A | * | 3/1912 | Powers | A43D 117/00 211/180 |
| 1,187,189 | A | * | 6/1916 | Sholl | D06F 53/04 211/119.12 |
| 1,293,582 | A | * | 2/1919 | Evera | F24F 6/04 237/78 R |
| 1,423,608 | A | | 7/1922 | Grossman | |
| 1,489,159 | A | * | 4/1924 | Schilling | D06F 55/00 211/119.12 |
| 1,815,673 | A | * | 7/1931 | Kelley | A47G 25/485 294/143 |
| 1,937,646 | A | * | 12/1933 | Fletcher | D06F 57/00 211/89.01 |

(Continued)

*Primary Examiner* — Devin K Barnett

(57) ABSTRACT

The invention includes a support for a linen basket and clothes pins. The present invention provides an innovative support system designed to streamline and enhance the process of air-drying clothes. The system features a flat surface configured to hold a linen basket, along with an integrated tray specifically designed for storing clothespins. Additionally, the invention includes elongated hanger members equipped with clothespins and attached to the underside of the flat surface. These hanger members are pivotally connected, allowing for flexible hanging of smaller items. The system also incorporates a versatile clamping mechanism for secure attachment to various types of vertical posts, including telescopic posts and tripods. The invention offers a user-friendly, adaptable, and efficient solution for air-drying clothes.

7 Claims, 6 Drawing Sheets

(56) References Cited

U.S. PATENT DOCUMENTS 2,202,427 A * 5/1940 Russell, V ..... E05B 69/006 312/287
2,205,904 A * 6/1940 Buel ..... D06F 57/12 211/89.01
2,317,437 A * 4/1943 Botta ..... A47G 25/0685 312/204
2,488,903 A * 11/1949 Edwards ..... D06F 57/12 248/222.51
2,598,614 A * 5/1952 Gilbert ..... A47G 25/743 211/89.01
2,630,922 A * 3/1953 Hess ..... A47G 25/0664 108/28
2,632,587 A * 3/1953 Pugel ..... B60R 7/04 224/927
2,964,202 A * 12/1960 Gingher ..... F16B 7/1472 108/30
3,046,041 A * 7/1962 Gingher ..... A47B 91/028 403/362
3,051,319 A * 8/1962 Glaser ..... A47F 5/04 211/133.4
3,178,033 A * 4/1965 Wirsing ..... A47K 10/14 D6/326
3,249,070 A * 5/1966 Day ..... A61B 50/33 108/26
3,583,571 A * 6/1971 Bonne ..... D06F 57/12 211/100
D221,970 S * 9/1971 Kelly ..... D6/403
3,635,522 A * 1/1972 Kerwit ..... A61G 15/10 297/118
3,735,875 A * 5/1973 Parillo ..... E05B 69/006 211/7
3,946,878 A * 3/1976 Stoveken ..... B42D 17/00 211/124
4,088,365 A * 5/1978 Johnson ..... B60R 7/00 248/200.1
D290,793 S * 7/1987 Lukezich ..... D6/681.2
4,932,539 A * 6/1990 Abinanti ..... A47B 96/1458 211/205
4,981,226 A * 1/1991 Shallenberg ..... A47F 5/0018 211/187
5,327,838 A * 7/1994 Beltman ..... A47B 25/00 108/26
5,505,318 A 4/1996 Goff
5,515,978 A * 5/1996 Moran ..... A47G 25/18 211/89.01
5,558,391 A * 9/1996 Chavous ..... A61G 5/10 297/153
5,725,111 A 3/1998 Choi
6,076,714 A * 6/2000 Wyenn ..... A47G 25/48 223/91
6,530,488 B1 * 3/2003 Krammes, Jr. ..... A01K 97/06 211/85.15
6,578,496 B2 * 6/2003 Guard ..... A47G 19/10 297/148
6,863,196 B1 * 3/2005 Carter ..... A47G 25/10 211/30
7,147,116 B1 * 12/2006 Cape ..... A47G 25/0685 211/115
D568,687 S * 5/2008 Lovett ..... D7/553.3
D604,977 S * 12/2009 Conville ..... D6/552
D642,389 S * 8/2011 Stumpo ..... D6/326
7,992,714 B1 * 8/2011 Devault ..... A47G 19/10 108/26
D662,746 S * 7/2012 Conville ..... D6/552
D687,637 S * 8/2013 Sheldon ..... D6/326
8,770,533 B2 * 7/2014 Hand ..... A47F 5/0892 242/379.2
D720,450 S * 12/2014 Glenn ..... D24/185
9,039,079 B2 * 5/2015 Huntsberger ..... A47D 1/0085 206/561
9,386,865 B2 * 7/2016 Bally ..... A61B 50/33
D809,836 S * 2/2018 Bailey ..... D6/681.2
10,709,235 B1 * 7/2020 Brown ..... A47B 5/04
10,709,238 B1 * 7/2020 Thompson ..... A47B 96/066
2002/0005389 A1 1/2002 Guo
2005/0247652 A1 * 11/2005 Barber ..... B44D 3/006 211/89.01
2009/0250417 A1 10/2009 McNiff et al.
2013/0200023 A1 * 8/2013 Brotzman ..... A47B 13/08 211/126.14
2014/0263110 A1 * 9/2014 Erickson ..... A47G 25/10 211/32
2015/0216602 A1 * 8/2015 Brotzman ..... A61B 50/15 108/106
2015/0335150 A1 * 11/2015 Frisby ..... A63H 33/006 211/207
2016/0106208 A1 * 4/2016 Kirkpatrick ..... A47F 5/0892 211/85.4
2017/0014016 A1 * 1/2017 Chan ..... A47L 19/04
2017/0099945 A1 * 4/2017 Meads ..... A47G 1/00
2018/0308373 A1 * 10/2018 Bogle ..... G09B 17/00

* cited by examiner

SUPPORT SYSTEM FOR A LINEN BASKET AND CLOTHES PINS

CROSS-REFERENCE TO RELATED APPLICATIONS

The present application claims priority to UK request GB2215129.4, filed on Oct. 13, 2022 which is hereby incorporated in its entirety at least by reference.

BACKGROUND OF THE INVENTION

1. Field of the Invention

The present invention relates generally to clothes drying devices but more particularly to a support system for a linen basket and clothes pins.

2. Description of Related Art

The practice of air-drying clothes has a long history, tracing its roots back to the advent of washing garments. Over time, various innovations have enhanced this age-old method. Initially, clothes were simply draped over a line, but the introduction of wooden clips offered a more secure way to hang them. This was later supplanted by modern clothespins equipped with metal springs for better grip. Another significant advancement came in the form of pulley-operated clotheslines, allowing users to move the line itself rather than walking along its length. This innovation was particularly useful for hanging clothes in elevated areas, such as balconies, where the line's other end was inaccessible from the ground.

While the use of clotheslines has declined in developed nations due to the prevalence of electric dryers, many people still prefer the gentle, natural drying process that avoids the damaging effects of hot air or chemical additives. Moreover, in numerous countries, air-drying remains the most practical and economical option.

However, the task of hanging clothes on a line presents certain challenges. One such issue is the inconvenience of bending down to retrieve clothes and pins from a basket. Additionally, sorting through a jumbled container of clothespins to find one that is both intact and easy to grip can be cumbersome. These difficulties are exacerbated for elderly individuals who may struggle with bending and grasping small objects. Consequently, there is a need for an improved system to streamline this process.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In one aspect of the invention, a support system for a linen basket and clothespins, comprising a flat surface configured to hold a linen basket; a tray integrated into the flat surface, designed for storing clothespins; a plurality of elongated hanger members attached to the underside of the flat surface, each hanger member equipped with clothespins; a clamping mechanism attached to the flat surface for securing the support system to a vertical post.

In one embodiment, the elongated hanger members are pivotally connected to hooks that are attached to the underside of the flat surface. In one embodiment, the clamping mechanism comprises a twist knob and clamping members adaptable to various pole shapes. In one embodiment, a pivot point that allows the flat surface to transition from a horizontal orientation to a vertical orientation is provided. In one embodiment, the vertical post is telescopic. In one embodiment, the vertical post is part of a tripod. In another embodiment, the tripod is equipped with wheels. In one embodiment, the vertical post is part of an existing clothesline structure. In one embodiment, the vertical post is part of a stand-alone structure. In one embodiment, the flat surface, tray, and elongated hanger members are made of a weather-resistant material.

The foregoing has outlined rather broadly the more pertinent and important features of the present invention so that the detailed description of the invention that follows may be better understood and so that the present contribution to the art can be more fully appreciated. Additional features of the invention, which will be described hereinafter, form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF THE DRAWINGS

Other features and advantages of the present invention will become apparent when the following detailed description is read in conjunction with the accompanying drawings, in which.

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a support system for a linen basket and clothes pins.

It is to be understood that the terminology used herein is for the purpose of describing particular embodiments only and is not intended to be limiting. The terms "a" or "an," as used herein, are defined to mean "at least one." The term "plurality," as used herein, is defined as two or more. The term "another," as used herein, is defined as at least a second or more. The terms "including" and/or "having," as used herein, are defined as comprising (i.e., open language). The term "providing" is defined herein in its broadest sense, e.g., bringing/coming into physical existence, making available, and/or supplying to someone or something, in whole or in multiple parts at once or over a period of time. These terms generally refer to a range of numbers that one of skill in the art would consider equivalent to the recited values (i.e., having the same function or result). In many instances these terms may include numbers that are rounded to the nearest significant figure.

Referring to any of the accompanying FIGS. 1-5, the present invention is a multi-functional support system for linen baskets and clothespins 10. This system aims to simplify the process of hanging clothes for air-drying, particularly catering to those who may find the task physically challenging. Advantageously, the present invention improves the traditional practice of air-drying clothes. This will be discussed in detail below.

Figure 1:
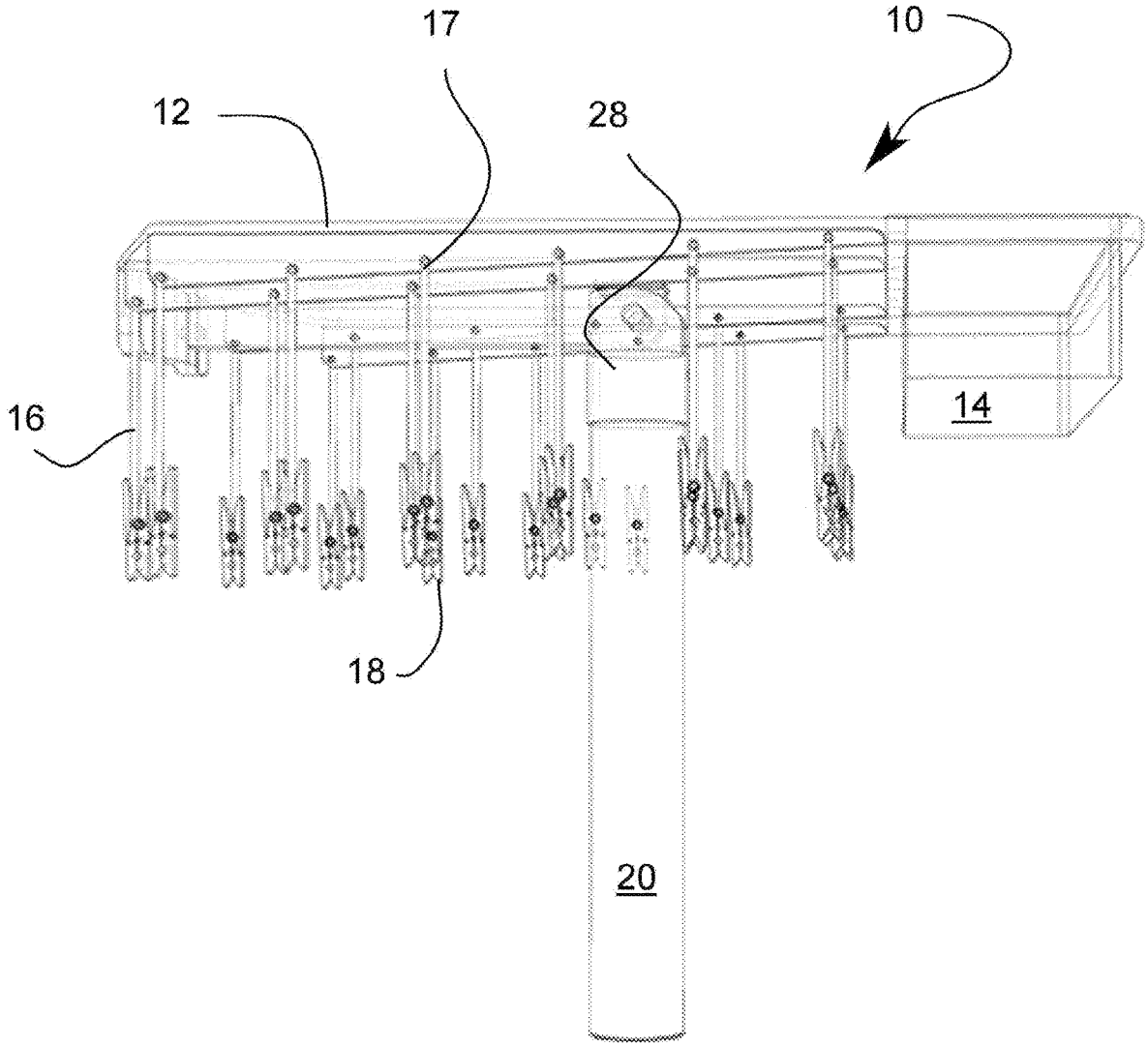
FIG. 1 is an isometric view of a support for a linen basket and clothes pins installed on a post according to an embodiment of the present invention.
Figure 2:
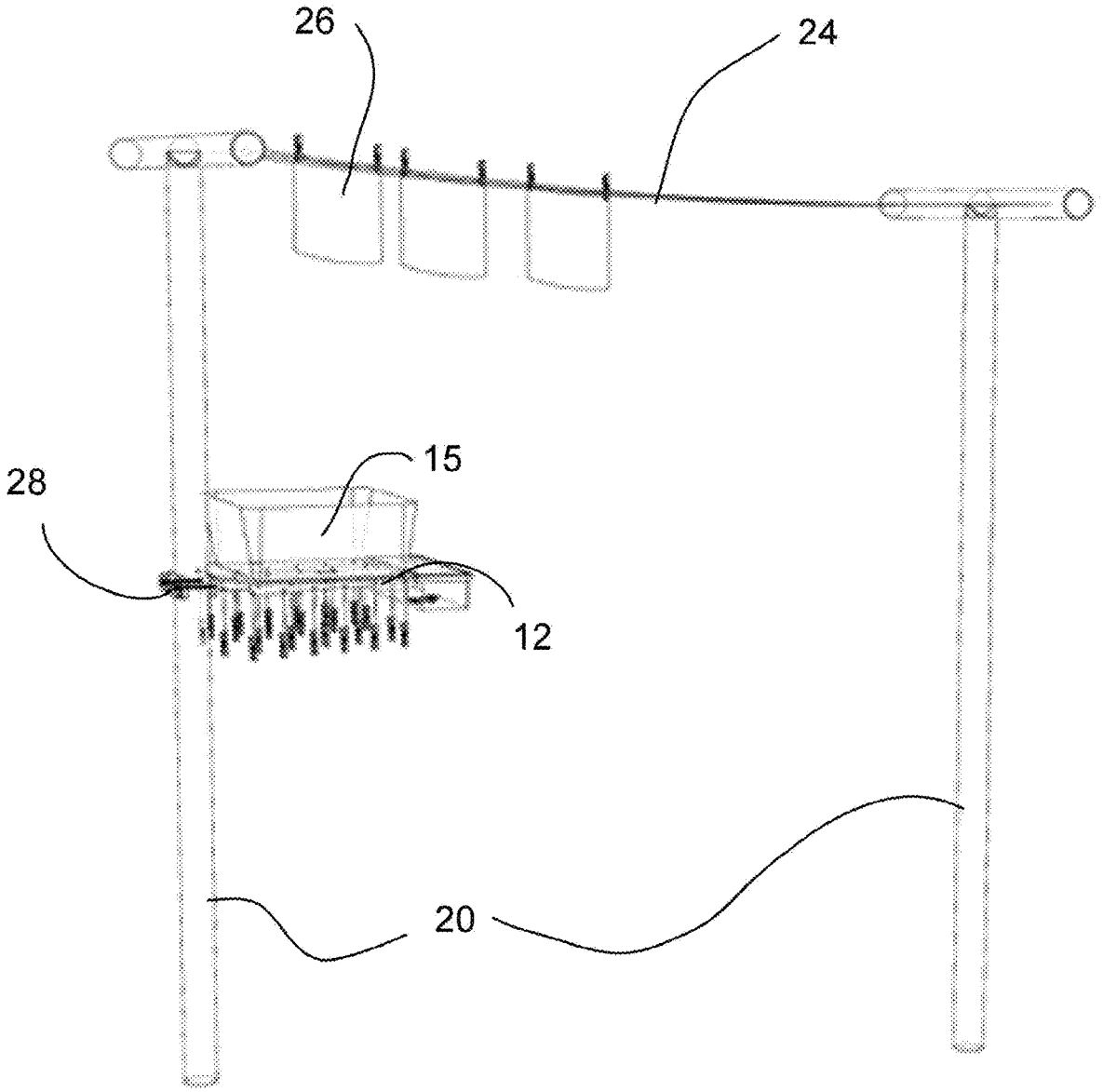
FIG. 2 is an isometric view of the present invention in use according to an embodiment of the present invention.

As illustrated in FIG. 1, in some embodiments, the core structure of the invention is a flat surface 12. This surface 12 is specifically designed to accommodate an existing linen basket 15 (as seen in FIG. 2), which is not part of the invention itself. Seamlessly integrated into this flat surface 12 is a specialized tray 14. In some embodiments, the tray 14 is designed to hold and organize clothespins 18 when not in use, thereby streamlining the entire process of hanging clothes for air drying. In one embodiment, the tray 14 sits below the plane of the flat surface 12.

Beneath the flat surface 12, there are a plurality elongated hanger members 16. In some embodiments, the hanger members 16 come equipped with attached clothespins 18, providing a convenient solution for hanging smaller items, such as socks and underwear. Adding to the functionality, in some embodiments, the hanger members 16 are pivotally connected to hooks 17. In some embodiments, the hooks 17 are securely fastened to the underside of the flat surface 12, allowing for a degree of flexibility and ease in the hanging process.

Figure 3:
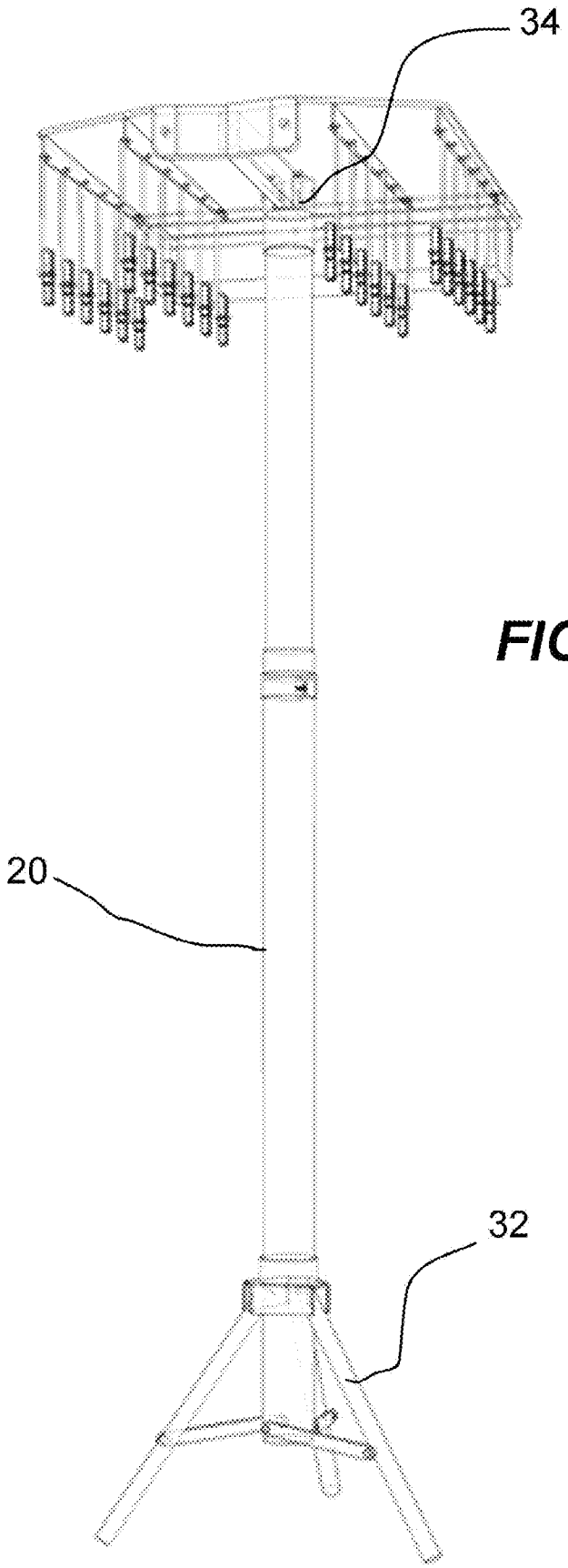
FIG. 3 is an isometric view of the present invention in use in conjunction with a tripod according to an embodiment of the present invention.
Figure 5:
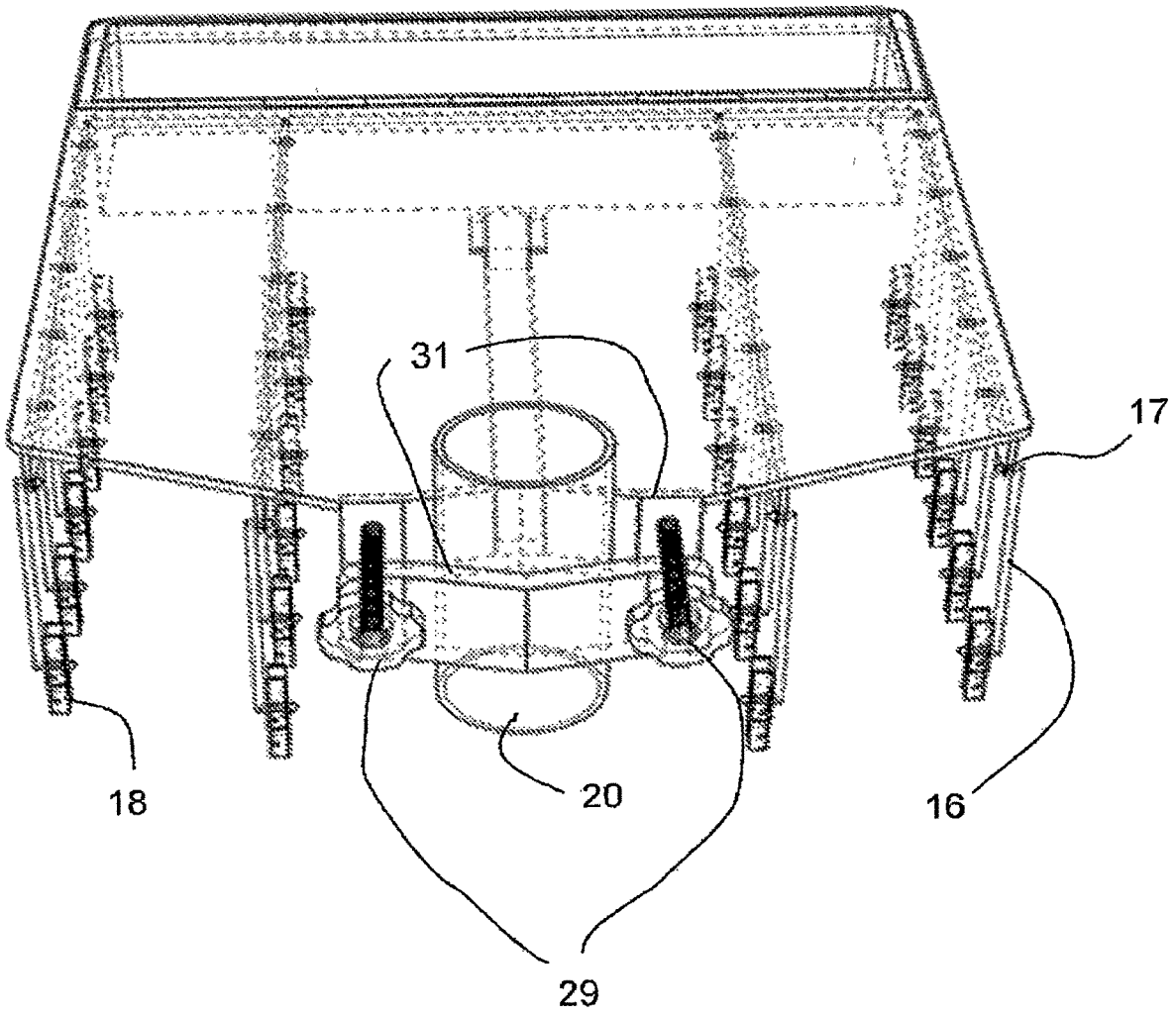
FIG. 5 is an isometric top transparent view of the support for a linen basket and clothes pins according to an embodiment of the present invention.

The invention is designed to be versatile in its mounting options. As shown in both FIGS. 1, 2 and 3, it can be securely fastened to a vertical post 20 forming part of a tripod, 32 as seen in FIG. 3, for example, or part of an existing clothesline structure 22 as per FIG. 2. To facilitate this, in some embodiments, the flat surface 12 incorporates a custom clamp 28 designed for fitting on top of the vertical post as seen in FIG. 1 or 3 or a highly adjustable clamping mechanism 31 as seen in FIG. 5, which can be used when clamping on the existing clothesline structure 22 of FIG. 2. The adjustable clamping mechanism 31 can be selectively loosened or tightened by means of a user-friendly twist knob 29 (best seen in FIG. 5) so as to be adaptable to a variety of pole shapes, be it square, elliptical, or round.

Figure 6:
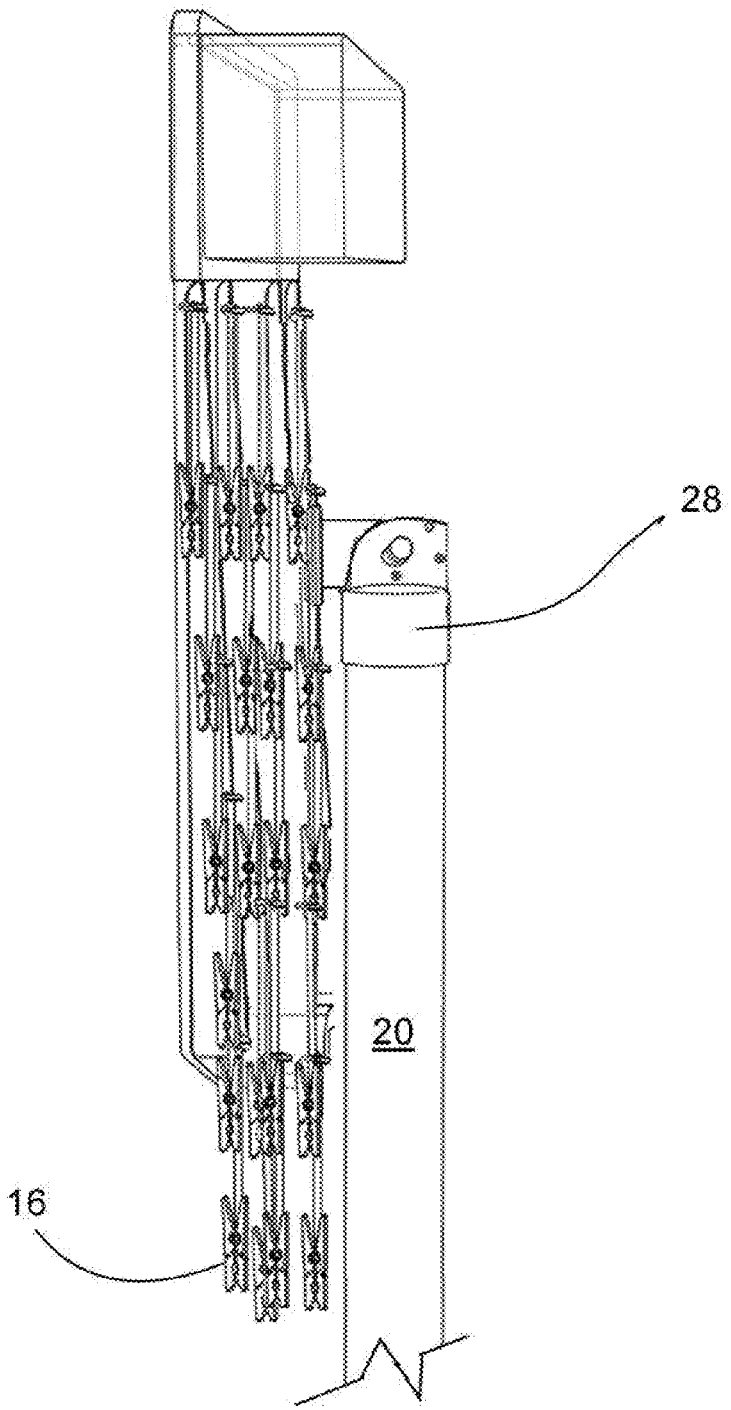
FIG. 6 is an isometric view of the support for a linen basket and clothes pins showing a flat surface of the support in a vertical orientation according to an embodiment of the present invention.

In FIG. 3, the invention is demonstrated in a different configuration where it is used in conjunction with a telescopic post 20 that is mounted on a tripod 32. This setup not only offers height adjustability for the system and flat surface but also includes a pivot point 34. This pivot point 34 allows the flat surface to transition from a horizontal orientation to a vertical one, making it easier to store the invention without having to disassemble it. The vertical orientation of the flat surface is shown in FIG. 6.

Figure 4:
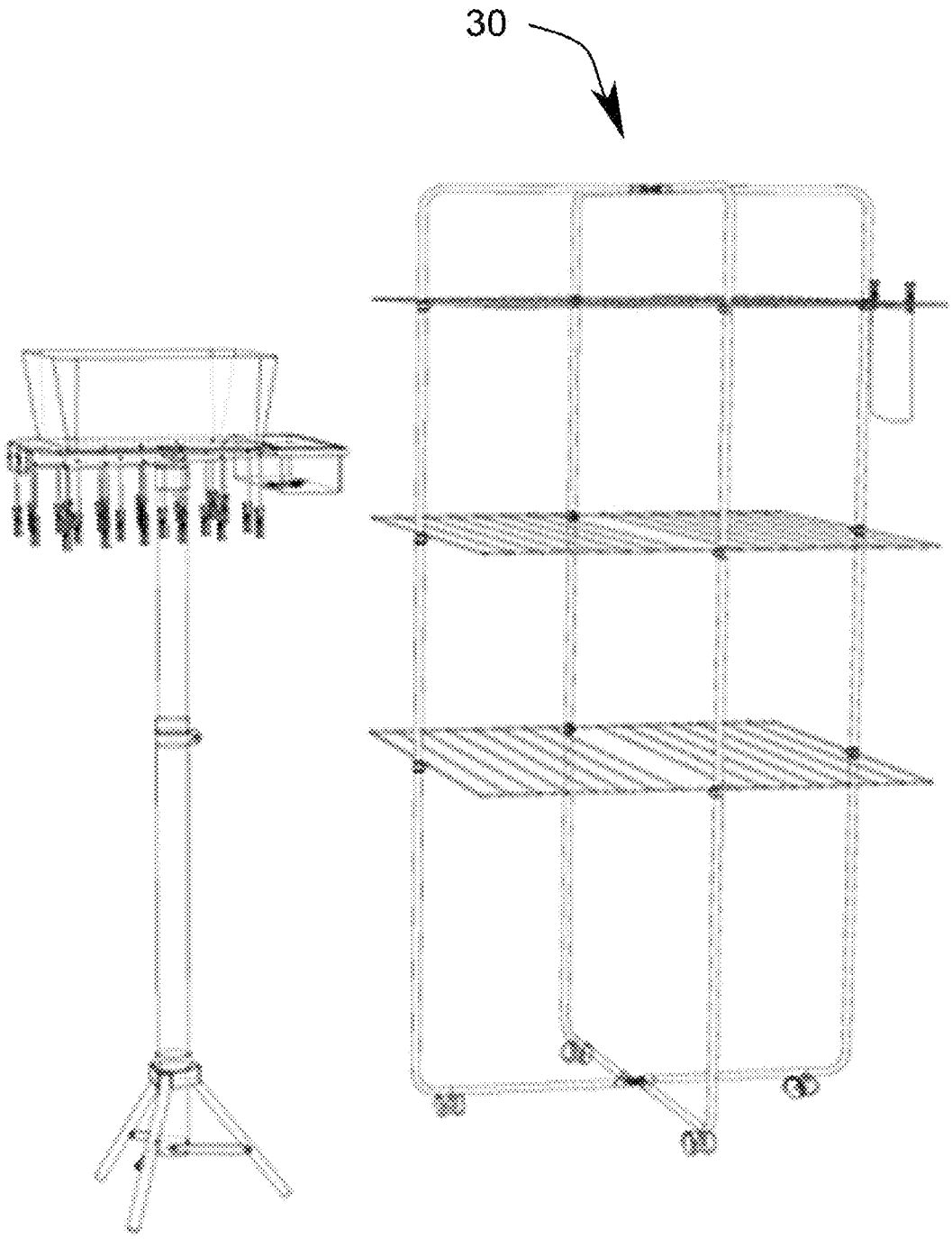
FIG. 4 is an isometric view of the present invention in use in conjunction with a drying rack according to an embodiment of the present invention.

FIG. 4 illustrates the present invention used in conjunction with a drying rack 30. While not explicitly shown in the figures, an optional feature worth mentioning is a tripod may be equipped with wheels. This feature would enable the support system 10 to be effortlessly moved as needed.

During use, the user would take a piece of clothing 26 from the linen basket 15 and place it on the clothesline 24 using one hand. Simultaneously, the user would grab a clothespin 18 from the specialized tray 14 with the other hand. The user would then secure the piece of clothing 26 to the clothesline 24 using the clothespin 18. This process is repeated for each piece of clothing 26. For smaller items, the user has the option to use the clothespins 18 that are located underneath the flat surface 12. To remove the clothes 26, the user would simply reverse this process.

Although the invention has been described in considerable detail in language specific to structural features, it is to be understood that the invention defined in the appended claims is not necessarily limited to the specific features described. Rather, the specific features are disclosed as exemplary forms of implementing the claimed invention. The terminology and phraseology used in this description and the abstract are for illustrative purposes and should not be considered as limiting. In other words, the terminology and phraseology used in this description and the abstract are for illustrative purposes and should not be considered limiting. Therefore, while exemplary illustrative embodiments of the invention have been described, numerous variations and alternative embodiments will occur to those skilled in the art. Such variations and alternative embodiments are contemplated, and can be made without departing from the spirit and scope of the invention.

It should further be noted that throughout the entire disclosure, the labels such as left, right, front, back, top, bottom, forward, reverse, clockwise, counterclockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, references to "first," "second," "third," and so fourth members throughout the disclosure (and in particular, claims) are not used to show a serial or numerical limitation but instead are used to distinguish or identify the various members of the group.

What is claimed is:

1. A support system for a linen basket and clothespins, comprising:

a flat surface configured to hold a linen basket;

a tray integrated into the flat surface configured for storing clothespins;

a plurality of elongated hanger members attached to the underside of the flat surface, each hanger member is equipped with a clothespin respectively;

a clamping mechanism attached to the flat surface for securing the support system to a vertical post; and, a pivot point that allows the flat surface to transition from a horizontal orientation to a vertical orientation.

2. The support system of claim 1, wherein the elongated hanger members are pivotally connected to hooks that are attached to the underside of said flat surface.

3. The support system of claim 1, further comprising a vertical post secured to the support system, and the vertical post being telescopic.

4. The support system of claim 1, further comprising a vertical post secured to the support system, and the vertical post further comprising a tripod.

5. The support system of claim 4, wherein the tripod is equipped with wheels.

6. The support system of claim 1, further comprising a vertical post secured to the support system, and the vertical post being a stand-alone structure.

7. The support system of claim 1, wherein the flat surface, the tray, and the elongated hanger members are made of a weather-resistant material.

* * * * *